United States Patent [19]

Thomson

[11] Patent Number: 4,475,363

[45] Date of Patent: Oct. 9, 1984

[54] ADJUSTABLE DUAL NODE SUPPORT ASSEMBLY FOR WASHING MACHINE

[75] Inventor: Benjamin M. Thomson, Louisville, Ky.

[73] Assignee: General Electric Company, Louisville, Ky.

[21] Appl. No.: 501,363

[22] Filed: Jun. 6, 1983

[51] Int. Cl.[3] ..... D06F 37/24

[52] U.S. Cl. ..... 68/23.3; 68/23 R; 248/638

[58] Field of Search ..... 68/3 R, 23.3, 23 R, 68/171, 172, 173, 174; 248/578, 636, 638

[56] References Cited

U.S. PATENT DOCUMENTS

| | | | |
|---|---|---|---|
| Re. 25,693 | 12/1964 | Behrens et al. | 68/24 |
| 2,335,834 | 11/1943 | Wood | 248/578 X |
| 2,604,771 | 7/1952 | De Remer | 68/172 X |
| 2,645,108 | 7/1953 | Smith | 68/174 X |
| 2,823,882 | 2/1958 | Ross | 248/578 |
| 2,976,998 | 3/1961 | Smith | 210/78 |
| 3,021,997 | 2/1962 | Czech | 233/23 |
| 3,026,700 | 3/1962 | Bochan et al. | 68/23 |
| 3,043,435 | 7/1962 | Castricone | 210/363 |
| 3,049,025 | 8/1962 | Lannert | 74/574 |
| 3,095,721 | 7/1963 | Bochan | 68/133 |
| 3,132,098 | 5/1964 | Bochan | 210/365 |
| 3,135,689 | 6/1964 | Antinori | 210/365 |
| 3,247,689 | 4/1966 | Wasemann | 68/23 |
| 3,269,544 | 8/1966 | Brucken et al. | 210/364 |
| 3,277,742 | 10/1966 | Jacobsen | 74/574 |
| 3,475,928 | 11/1969 | Wasemann | 68/23.2 |
| 3,493,118 | 2/1970 | Brucken | 210/364 |
| 3,598,460 | 8/1971 | Conrath et al. | 308/238 |
| 3,922,891 | 12/1975 | Sundstrom, Jr. | 68/23.3 |
| 3,922,892 | 12/1975 | Bochan | 210/364 |
| 4,333,322 | 6/1982 | Billings et al. | 68/23 R X |
| 4,402,199 | 9/1983 | Waugh | 68/23 R X |
| 4,403,484 | 9/1983 | Fey et al. | 68/23 R X |

FOREIGN PATENT DOCUMENTS

| | | | |
|---|---|---|---|
| 130909 | 1/1949 | Australia | 248/638 |

*Primary Examiner*—Philip R. Coe

*Assistant Examiner*—Frankie L. Stinson

*Attorney, Agent, or Firm*—Frank P. Giacalone; Radford M. Reams

[57] ABSTRACT

A support assembly for a washing machine includes a mount secured to the assemblage of working parts of the machine and adapted to move with the assemblage during operation of the machine and a cabinet structure enclosing the assemblage of working parts and having a base. An intermediate member is positioned between the mount and the base for movably supporting the mount and the assemblage of moving parts from the base. The base and intermediate member are formed with a first set of mating support surfaces for sliding movement therebetween and the mount and the intermediate member are formed with a second set of mating support surfaces for sliding movement therebetween. One set of the support surfaces is smoothly curved with a relatively short radius of curvature to form a first node for movement of the mount and the other set of support surfaces is smoothly curved with a relatively long radius of curvature to form a second node for movement of the mount. Means provides the interface of the one set of support surfaces with a relatively low coefficient of friction and means provides the interface of the other set of support surfaces with a relatively high coefficient of friction so that relative movement between the intermediate member and either of the base and the mount tends to be between the one set of support surfaces. The intermediate member and the one of the base in the mount forming the one set of support surfaces come into interfering engagement upon predetermined amplitude of movement of the mount so that further relative movement between the one set of support surfaces is substantially inhibited and relative movement between the other set of support surfaces occurs in response to movement of the mount in excess of the predetermined amplitude. Means provides for adjusting the frictional contact pressure between the intermediate member and the mount to select the degree of damping therebetween.

3 Claims, 6 Drawing Figures

ADJUSTABLE DUAL NODE SUPPORT ASSEMBLY FOR WASHING MACHINE

BACKGROUND OF THE INVENTION

It is well known to provide a support assembly for the mounting or suspension of the operating components of clothes washing machines, which assembly moves in a nodal fashion in damping out undesirable movement of the operating components of the machine. A number of such mounts or suspensions have been or currently are in production by various manufacturers of upright washers. The support assembly has two, somewhat conflicting, objectives. A general object of such assemblies is to minimize the unbalance forces exerted on the cabinet at the pivotal or nodal point of movement. Such unbalance forces tend to cause vibration of the floor and movement or walking of the washing machine.

The second object is to control excursion of the working components of the machine, particularly the clothes basket or receptacle, during the spin operation. Such excursions may become particularly large as the clothes receptacle passes through what is called the "critical" speed. In order to centrifugally extract the maximum amount of water from the fabrics which have been washed or rinsed, the basket is rotated at very high speed. In the critical speed range of the basket, the excursion of the basket caused by unbalanced loads tends to become regenerative and the basket tries to move far off its central axis. This can cause the basket to strike other components of the machine and cause objectionable noise or damage the machine. The support assembly applies a frictional force opposing such large excursions, particularly as the receptacle approaches through its critical speed range. Thus it can be seen that the object of isolating unbalance forces from the cabinet is enhanced by reducing as much as possible the frictional forces present in the support assembly during small excursions while damping unwanted large excursions is enhanced by increasing the frictional forces opposing the excursion.

When the clothes receptacle is spun or rotated at high speed to centrifugally extract water from fabrics, the moving system tends to move about a point in space which can be termed its natural node of operation. Often with currently produced machines this natural node is at a point below the surface on which the machine is sitting. In damping the movement of the system during spin, particularly during the critical speed range, frictional forces are applied to the system. It is advantageous that these frictional forces during critical speed be made as large as practical if the unbalanced load will cause large excursions. At the same time it is of benefit in reducing the forces transmitted to the support surface and thus the resulting tendency of the machine to vibrate or walk if such frictional forces are applied so that they pass through the natural node of movement of the machine.

When the basket has passed through the critical speed range and is approaching terminal speed, the moving system tends to center itself and not vibrate or oscillate far off of the vertical axis of the machine. It is advantageous to provide a low friction support arrangement for the machine which allows it to move in the small arcs or excursions with minimum frictional forces in the system, as the higher the degree of friction the greater the vibrational forces transferred to a cabinet and support surface. Also some machines, such as orbiting or wobble machines for example, have a natural node of operation during agitation operations, that is when the fabrics are being agitated in liquid to wash or rinse them. This second or agitation node of operation often is different than the natural node of operation during the centrifugal extraction step or phase. It is advantageous to provide a mount for the working components of a machine which has minimal frictional resistance to movement of the basket during the terminal speed spin and during agitation operations with minimum friction. The reduction of the frictional forces or torque can be enhanced both by using low coefficient of friction interface and by making the relatively movable surfaces as close to the vertical axis of the machine as possible in order to minimize the radius. In the machines which have a second natural node of operation during their agitation operation it is advantageous to have the low friction node of the support assembly approximate the natural agitation node of the machine.

Copending application of Richard A. Waugh, 9D-HL-14796, and assigned to General Electric Company, assignee of the present invention, is incorporated herein by reference. That application illustrates and describes a suspension assembly which provides relatively low frictional force resistance to low amplitude movement of the machine mount and relatively large frictional force resistance to large amplitude movement of the mount. However the entire suspension assembly is constructed such that all the relative movement is about a single node, preferably the natural node of operation during centrifugal extraction.

SUMMARY OF THE INVENTION

It is therefore an object of the present invention to provide a new, improved support assembly for upright washing machines.

It is another object of the present invention to provide such an improved support assembly which provides two nodes of operation in response to differing excursions of the working components of the machine.

It is yet another object of the present invention to provide such an improved support assembly in which adjustable relatively large frictional forces are applied about a node approximating the natural node of operation of the machine during centrifugal extraction to resist large amplitude excusions of the machine.

It is yet another object of the present invention to provide such an improved support assembly in which the mount has a node of operation of minimal frictional resistance to small amplitude excursions of the moving system of the machine.

In accordance and with one embodiment of the present invention there is provided a support assembly for a washing machine having an assemblage of working parts for agitation of fabrics in a liquid for washing the fabrics and centrifugal extraction of the liquid from the fabrics. The support assembly comprises a mount secured to the assemblage of working parts for movement therewith during operation of the machine. An intermediate member is positioned between the mount and the base of the machine for movably supporting the mount, and the assemblage of working parts, from the base. The base and the intermediate member are formed with a first set of mating support surfaces for sliding movement therebetween. The mount and the intermediate member are formed with a second set of mating support surfaces for sliding movement therebetween. One of the sets of support surfaces is smoothly curved with a relatively short radius of curvature to form a first node for movement of the mount and the other of the sets of support surfaces is smoothly curved with a relatively large radius of curvature to form a second node for movement of the mount. The interface of the one set of support surfaces is provided with a relatively low coefficient of friction and the interface of the other set of support surfaces is provided with a relatively high coefficient of friction so that relative movement between the intermediate member and either the base or the mount tends to be between the one or both sets of support surfaces. The intermediate member and the one of the base and the mount forming the one set of support surfaces come into interfering engagement upon a predetermined amplitude of movement of the mount so that relative movement between the one set of support surfaces is substantially inhibited and relative movement between the other set of support surfaces occurs in response to movement of the mount in excess of the predetermined amplitude. Adjustment of the frictional contact pressure between the intermediate member and the mount select the degree of damping therebetween when the predetermined amplitude is exceeded.

The above mentioned and other features and objects of this invention will become more apparent, and the invention itself will be more fully understood by reference to the following description, taken in conjunction with the accompanying drawings wherein:

DESCRIPTION OF THE PREFERRED EMBODIMENT

Figure 1:
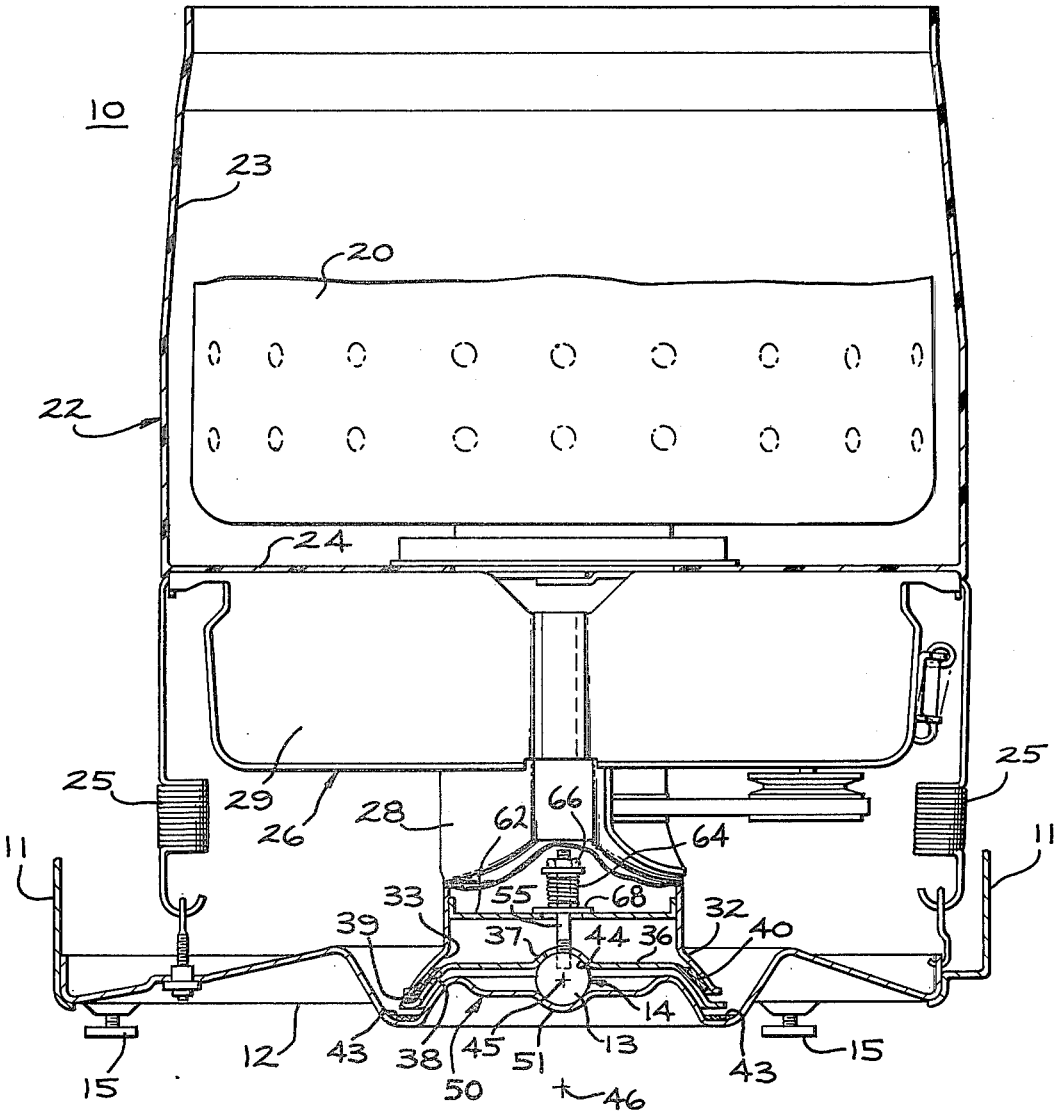
FIG. 1 is a simplified, schematic, cross-sectional elevational view of a fabric washing machine incorporating one form of the invention, with some parts of the machine omitted for the sake of simplicity.

Referring to the drawings, particularly FIGS. 1–4, there is shown a washing machine 10 of the upright or generally vertical axis type including a cabinet having side walls 11 and a top, which has been omitted for the sake of simplicity. The cabinet also includes a base or bottom frame 12 formed at its center to receive a member 13 having a generally spherical bearing or support surface 14 for supporting the assembly of working parts of the machine. The generally spherical bearing surface 14 provides a mount or suspension of the fixed node type. That is, the mechanism mounted on surface 14 will move about the sphere of which the surface 14 is a part. It will be understood that spherical is used herein in its general sense, including both structures having the form of the sphere amd structures having the form of a segment of a sphere. While the member 13 is illustrated as a separate component constructed of a low friction material such as tetrafluoroethylene, it will be understood that the spherical surface 14 may be provided by an upwardly extending generally spherical projection of the base or bottom frame 12 itself.

A number of support feet 15 are threadedly engaged in the bottom frame 12. The height of each foot can be adjusted in order that the base or bottom frame 12 will have a level or horizontal disposition even though the support surface on which the machine is mounted may not be horizontal.

The illustrative washing machine is of the orbital type, containing a perforate basket or fabric receptacle 20 which receives fabrics to be washed. In the agitation or washing and rinsing phases of its operation, the basket 20 is caused to orbit about the central vertical axis of the machine in order to agitate or move the fabrics in the wash and rinse liquid. This imparts wash and rinse action to the fabrics. In its centrifugal extraction phase of operation the basket is rotated or spun at high speed about the vertical axis of the machine in order to centrifugally extract the spent liquid from the fabrics. The basket 20 is received in an imperforate, stationary or nonrotatable tub 22 having an upright peripheral side wall 23 and a generally horizontal bottom wall 24. The tub 22 is received in the cabinet of the washing machine. Additional details of the construction operation of an orbiting type washing machine may be had by reference to the copending application of Robert M. Fey et al, Ser. No. 306,025, filed Sept. 28, 1981 and assigned to General Electric Company, assignee of the present invention, which application is herein incorporated by reference. It will be understood that while the illustrative washing machine is of the orbiting type, the present invention is useful in other types of upright washing machines such as wobble washers and the mechanical agitator type washers, whether the mechanical agitator oscillates about a vertical axis or reciprocates along the vertical axis.

The assemblage of working components of the machine are pivotally supported by a mount 26 including a hollow, upright mounting post 28. Attached to the upper end of mounting post 28 by suitable means such as welding is a tub support structure 29 which conveniently may have three generally radially extending arms having flat upper portions on which the tub 22 is mounted. The tub may be mounted to the support structure 29 by suitable means such as bolts (not shown). The arms of the tub support structure 29 also form the support for various other components of the machine, such as the transmission and the drive motor and for counter weights used to evenly distribute the weight applied to the post 28, which have been omitted for the sake of simplicity. Additional details of a mount of the type shown in FIG. 1 may be had by reference to U.S. Pat. No. 4,333,322-Billings et al, assigned to General Electric Company, assignee of the present invention, which application is herein incorporated by reference.

The lower portion of mounting post 28 is generally cylindrical in cross section and its lower end is formed into a support portion 32 having a downwardly facing generally spherical support surface 33. An intermediate member 36 is interposed between the bearing or support member 13 and the support portion 32 of the mount. The intermediate member 36 is formed with an upwardly projecting generally spherical socket 37 having a lower support surface 44 conforming to the bearing or support surface 14. It is also provided with a support section 38 having an outer or upper upwardly facing generally spherical support surface 39 complimentary to the support surface 33. An annulus 40 of relatively high coefficient of friction material is attached to the support surface 33 and bears against the support surface 39. For example, annulus 40 may conveniently be lubricated wool felt. This provides a high coefficient of friction interface between the support surfaces 39 and 33. The low coefficient of friction material of which the member 13 is composed provides a low coefficient of friction interface between its surface 14 and the socket 37 and more specifically between the base 12 and member 36. It will be understood that the member 13, which in this embodiment is a sphere, can be replaced by an upwardly extending generally spherical projection of the base itself and the low coefficient of friction interface may be provided by use of suitable permanent lubricant. In the embodiment shown in FIGS. 1-4, to accommodate the member 13 between base 12 and member 36, the base 12 includes a pedestal 50 having a downwardly projecting socket 51 while the intermediate member 36 includes an upwardly projecting socket 52. The member 13 is received between the sockets 51 and 52. The center of the member 13 forms the first node of movement 45. The member 13 may be formed of a low coefficient of friction material or the joint formed by the ball in the mating socket may be provided with a low coefficeint of friction interface by use of appropriate permanent lubricant.

Springs, such as those shown at 25, connect the mount 26 to the base 12 and bias the moving structure of the machine so that the post 28 tends to center itself on the bearing surface provided by intermediate member 36 and intermediate member 36 tends to center itself on the member 13. The springs also help prevent the mount from bouncing or lifting from the base during operation.

Figure 2:
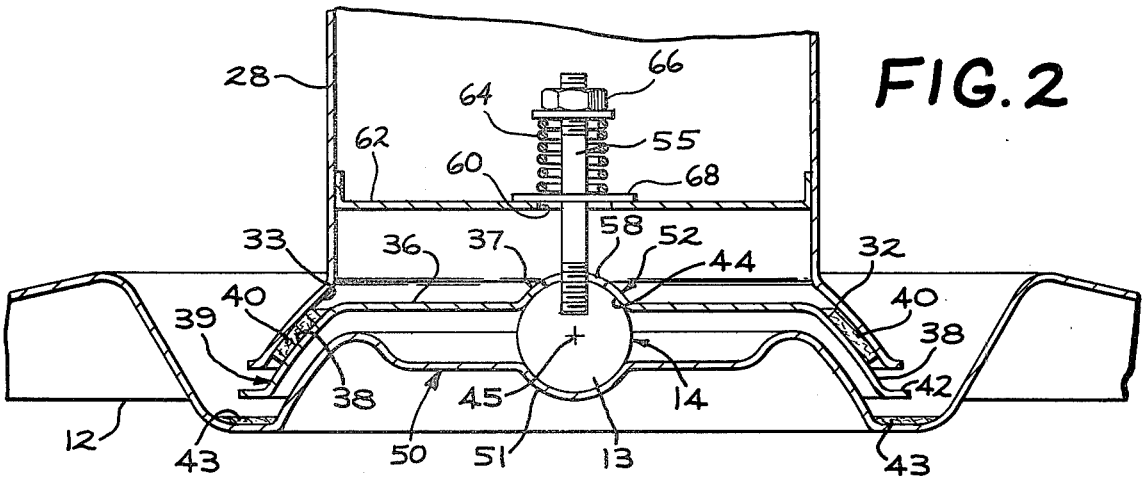
FIG. 2 is an enlarged fragmentary elevational view of a portion of the machine of FIG. 1 showing some of the components of the support assembly in a centered or upright position.
Figure 3:
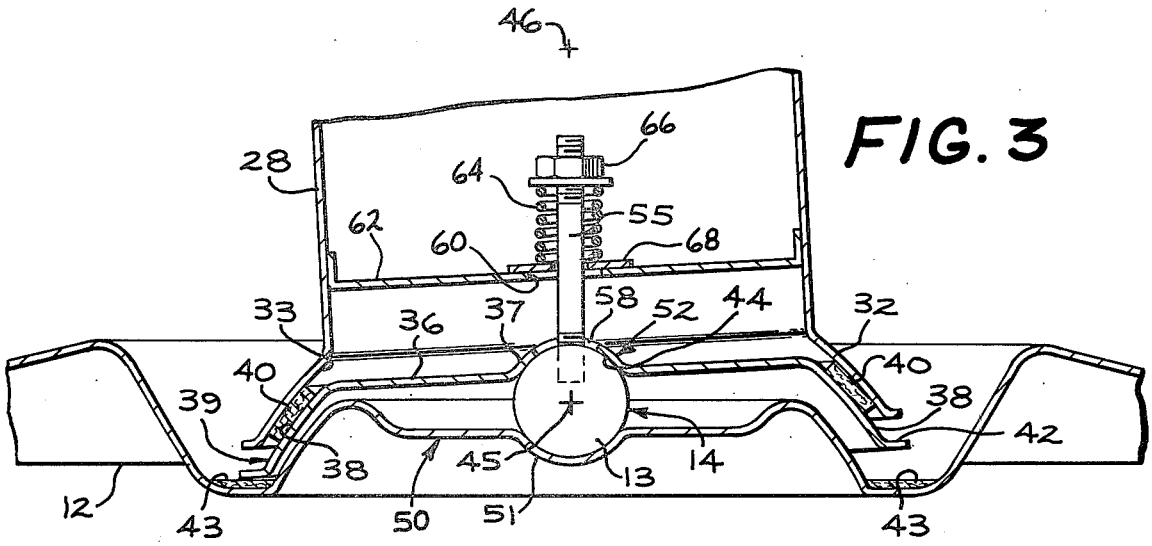
FIG. 3 is a view similar to FIG. 2 but with the mount tilted slightly off center.
Figure 4:
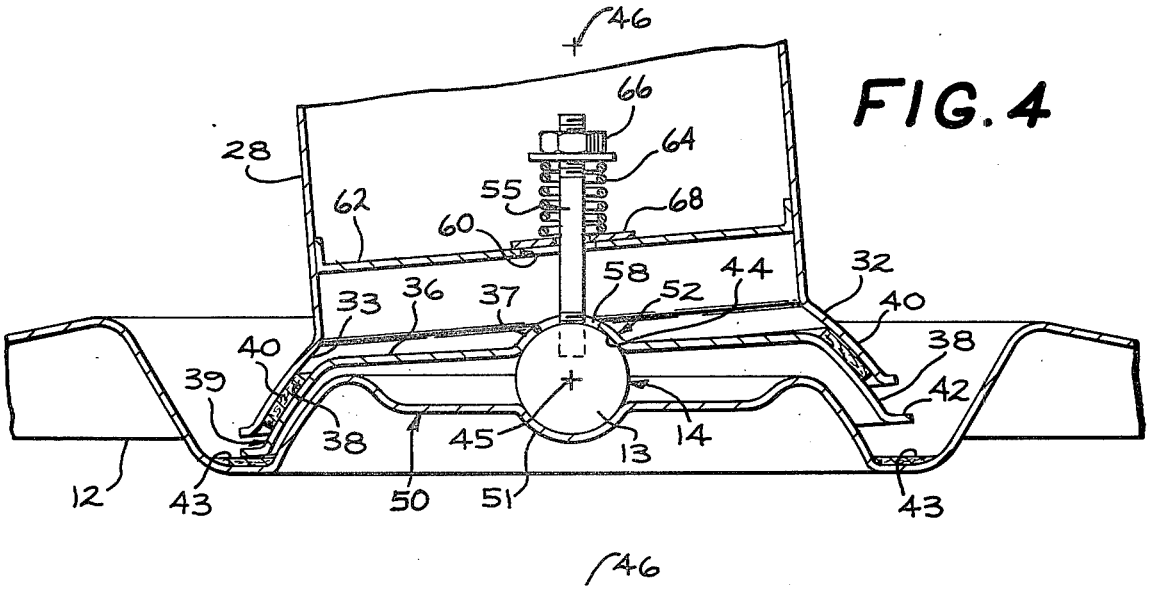
FIG. 4 is a view similar to FIG. 2 but with the mount in a more extreme off centered position.

Referring now more particularly to FIGS. 2-4, the functioning of the support assembly during machine operation will be described. FIG. 2, like FIG. 1, shows the nominal position of the mounting post 28 and intermediate member 36 with the machine off. In this position the mount is centered on the intermediate member 36 and the intermediate member 36 is centered on the bearing member 13. Additionally the outwardly extending flange 42 formed at the outer edge of the intermediate member 36 is spaced from an annulus 43 of high friction or shock absorbing material, such as felt, attached to the base 12.

During agitation of the fabrics in order to perform washing and rinsing operations, whether such agitation results from the orbiting of the basket 20 in the illustrative machine, wobbling of a basket in a wobble type machine or some form of oscillation or reciprocation of a mechanical agitator in a well known agitator type machine or other forms of mechanical action, the mounting post will tend to move about the generally vertical axis of the machine with excursions of relatively small amplitude. The bearing or support surface 14 of member 13 and the lower or mating surface 44 of the socket 37 of intermediate member 36 are segments of concentric spheres having a common center 45. This center 45 forms a first node of operation of a machine. Since the interface between the surfaces 33 and 39 has a relatively high coefficient of friction and the interface between the surfaces 14 and 44 has a relatively low coefficient of friction the operating components of the machine and mounting post 28 tend to move with the intermediate member 36 about the center or node 45 with relative motion occurring between the surfaces 14 and 44, as shown in FIG. 3. The relatively low coefficient of friction at the interface and the small radius of the spherical surfaces 14 and 44 both minimize the frictional forces and thus minimize the torque applied to the base 12 of the machine which might tend to cause the machine to move or walk on the support surface. In machines, such as, for example, orbital washing machines, in which the moving system of the machine has a natural node of movement during agitation operations it is further advantageous to construct the support assembly so that the center or node 45 approximates the agitation natural node of movement of the machine. In that case the forces exerted on the base through the member 13 pass through the node and the tendency for the cabinet to vibrate or move is lessened even more.

When the excursion or tipping of the mounting post 28 becomes sufficiently large, most typically as the fabric receptacle passes through its critical speed range during centrifugal extraction of liquid from the fabrics, annular edge or flange 42 of the intermediate member 36 engages the annulus 43 of damping or friction material, such as a "cork like" material for example, in the base 12, as shown in FIG. 4 for instance. This provides an interfering engagement between the intermediate member 36 and the base 12 and additional movement of the mounting post 28 in the same direction, for instance to the left as seen in FIG. 4, causes relative motion to occur between the intermediate member 36 and the mounting post 28. More particularly the relative movement occurs in the interface between the surface 39 and the surface 33 provided by the annulus 40 of friction material. Since the annulus 40 provides a relatively high coefficient of friction at a large radius surface the large amplitude of movement of the post 28 is resisted or damped. The annulus 40 is illustrated as attached to and moving with surface 39 over surface 33. The opposite construction also could be used. That is, annulus 40 could be attached to surface 33 and have a sliding engagement with surface 39.

The surfaces 33 and 39 are portions of coaxial spheres having a common center or node 46 providing a second node of movement for the suspended system of the washing machine. As previously described the suspended system of most washing machines has a natural node of operation during centrifugal extraction. While this node may vary in an individual machine depending on the amount of water and the load of fabrics in the machine it remains within the general region of its designed location. It's of additional benefit to provide that the node 46, defined by the center curvature of the surfaces 33 and 39, approximates the centrifugal extraction natural node of operation of the machine. This helps reduce the torque applied to the base of the machine which tends to cause the machine to vibrate or move over the support surface.

By the present invention, means are provided for adjusting or selecting friction contact pressure between the intermediate member 36 and post 28 and more particularly between surfaces 33 and 39.

To this end, a bolt-like member 55 including a body portion and upper and lower threaded portions is secured at its lower end to the member 13. The lower threaded portion of member 55 as shown matches threads in the upper portion of member 13. The member 55 extends upwardly from member 13 through an enlarged opening 58 in intermediate member 36. The upper end is arranged to extend through an enlarged opening 60 in a bracket 62. The bracket 62 is secured to the side walls of the post 28 in any suitable manner, such as by welding. A nut 66 is threadly mounted on the upper free end of bolt 55. A spring 64 is positioned between the adjusting nut 66 and a plate 68 bearing on the upper surface of bracket 62. By adjusting the position of the nut 66 on the bolt 55 the compression of spring 64 is altered and, accordingly, the friction contact pressure between the surface 39 of the intermediate member 36 and the surface 33 of the post 28 is controlled or selected. By the present invention, the relatively high coefficient of friction between the surfaces 38 and 39 can be selected so that movement about the node 46 can be predetermined.

Figure 5:
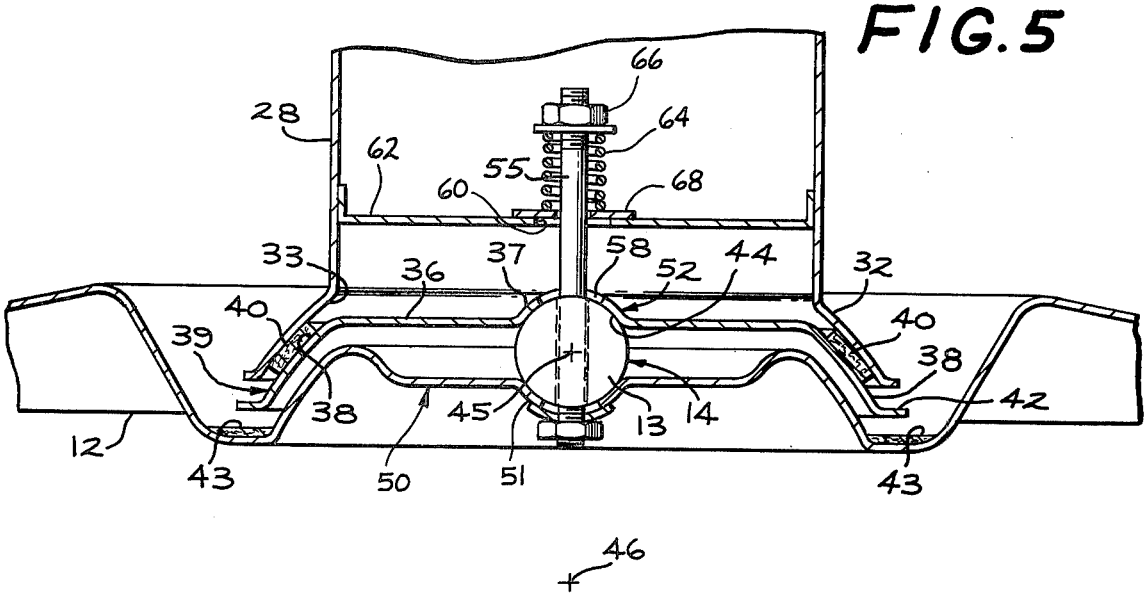
FIG. 5 is a view similar to FIG. 2 showing the portion of a support assembly incorporating another embodiment of the present invention.
Figure 6:
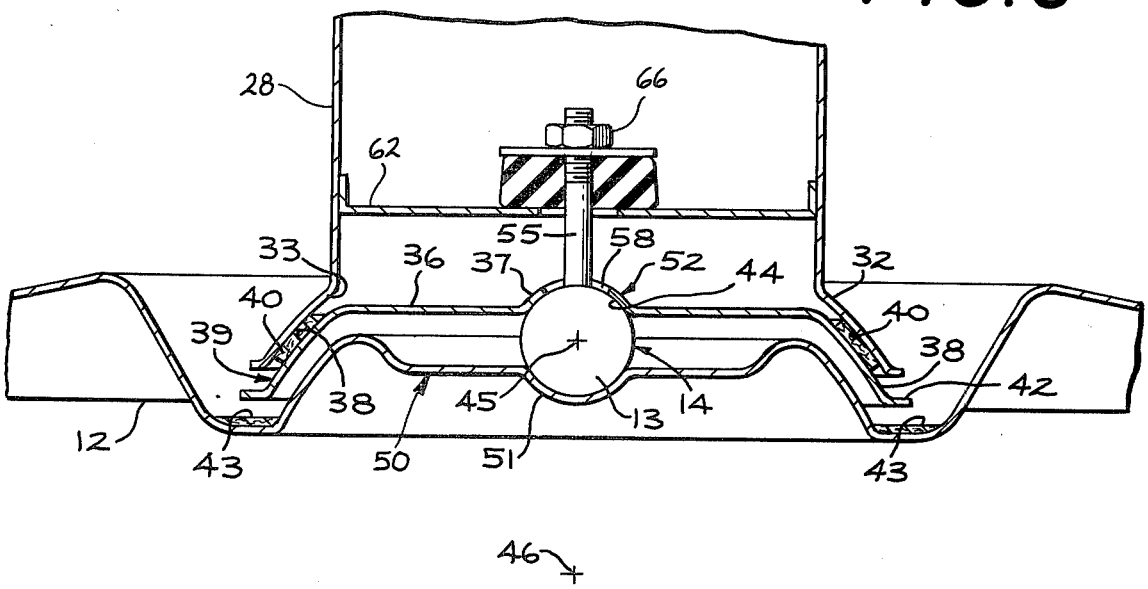
FIG. 6 is a view similar to FIG. 2 but showing a portion of a support assembly incorporating yet another embodiment of the present invention.

FIGS. 5 and 6 illustrate support assemblies including other embodiments of the present invention. In describing FIGS. 5 and 6, like numerals are used to identify corresponding parts. In the support assembly of FIG. 5 the bolt 55 extends through the member 13. In the support assembly of FIG. 6 in place of the spring 64 a resilient pad member is employed. The operation of the system including the embodiment of FIGS. 5 and 6 is substantially the same as that of the system shown in FIG. 1. In summary, by the present invention, the turning or adjustment of nut 66 relative to bolt 55 adjusts the frictional contact pressure between the intermediate member 36 and the post 28.

It should be apparent to those skilled in the art that the embodiment described heretofore is considered to be the presently preferred form of this invention. In accordance with the Patent Statutues, changes may be made in the disclosed apparatus and the manner in which it is used without actually departing from the true spirit and scope of this invention.

What is claimed is:

1. A support assembly for a washing machine having an assemblage of working parts for agitation of fabrics in a liquid for washing the fabrics and centrifugal extraction of liquid from the fabrics, the support assembly comprising:

a mount secured to the assemblage of working parts and adapted to move therewith during operation of the machine;

a cabinet structure enclosing the assemblage of working parts and said mount, said cabinet including a base;

an intermediate member positioned between said mount and said base for movably supporting said mount and the assemblage of moving parts from said base;

said base and said intermediate member being formed with a first set of mating support surfaces for sliding movement therebetween;

said mount and said intermediate member being formed with a second set of mating support surfaces for sliding movement therebetween;

one of said sets of support surfaces being smoothly curved with a relatively short radius of curvature to form a first node for movement of said mount, the other of said sets of support surfaces being smoothly curved with a relatively long radius of curvature to form a second node for movement of said mount;

means providing the interface of said one set of support surfaces with a relatively low coefficient of friction and means providing the interface of said other set of support surfaces with a relatively high coefficient of friction so that relative movement between said intermediate member and either of said base and said mount tends to be between said one set of support surfaces;

said intermediate member and the one of said base and said mount forming said one set of support surfaces coming into interfering engagement upon a predetermined amplitude of movement of said mount so that relative movement between said one set of support surfaces is substantially inhibited and relative movement between said other set of support surfaces occurs in response to movement of said mount in excess of the predetermined amplitude; and adjusting means interacting between said intermediate member and said mount for adjusting the frictional contact pressure between said other of said sets of support surfaces for predetermining at what amplitude of force relative movement between said other set of support surface occurs.

2. A support assembly for a washing machine recited in claim 1 wherein said base and said intermediate members are formed with cooperating surfaces being dimensioned to receive therebetween a spheral like member forming said first node.

3. A support assembly for a washing machine recited in claim 2 wherein said adjusting means further includes an upwardly extending stem member secured at its lower end to said spheral like member, said stem member at its lower end extending through an enlarged opening in said intermediate member and having its upper end extending through an enlarged opening in a bracket member secured to said mount, an adjusting member on the upper portion of said stem member being movable vertically relative thereto, a resilient member arranged on said stem member between said adjusting member and said bracket member whereby vertical movement of said adjusting member causes the frictional contact pressure between said other of said sets of support surfaces to be preselected.

* * * * *